United States Patent [19]

Sparks

[11] Patent Number: 4,763,485

[45] Date of Patent: Aug. 16, 1988

[54] HEAT PUMP CONTROLLER

[76] Inventor: Robert L. Sparks, 4033 Middlesex Pl., Sarasota, Fla. 34241

[21] Appl. No.: 55,369

[22] Filed: May 29, 1987

[51] Int. Cl.[4] ..... F25B 13/00; F25D 19/00

[52] U.S. Cl. ..... 62/160; 62/298

[58] Field of Search ..... 52/298, 324.1, 262, 52/259.1, 263, 160, 77; 237/2 B

[56] References Cited

U.S. PATENT DOCUMENTS 3,611,743 10/1971 Manganaro ..... 62/298

3,740,964 6/1973 Herweg ..... 62/262

*Primary Examiner*—Henry A. Bennet

*Attorney, Agent, or Firm*—Charles J. Prescott; Raymond H. Quist

[57] ABSTRACT

Inside and outside electrical control adaptors are provided for the installation of heat pump systems where only two or three conductors extend between the inside components and the outside components of the system. The inside adaptor has two relays which provide alternate circuits between the inside to outside conductors and the indoor control wiring. The outside adaptor similarly provides alternate circuits between the inside to outside conductors and the outdoor control wiring.

11 Claims, 1 Drawing Sheet

HEAT PUMP CONTROLLER

BACKGROUND OF THE INVENTION

1. Field of the Invention

This invention relates generally to the installation of a heat pump, and more particularly to the replacement of a central air conditioner and furnace with a heat pump.

2. Description of Related Art

Many older houses, particularly in warmer climates were equipped with central air conditioning units which provided only cooling, and separate devices, if any, for the provision of heat. In some cases, common ductwork served both the air conditioner and the heater and a single blower served for both heating and cooling. Changing costs of fuel and electricity have made a heat pump an economical substitute for these existing systems. The control wiring for the heat pump system, however, differs substantially from that of the old system. Typically, the old control wiring for the condensing unit only required two conductors although a three conductor cable was commonly installed when the house was being built. Once the house is completed, however, it is frequently difficult to run new control wiring.

A similar problem exists with some multiple dwelling buildings in which the existing outside air conditioning unit is connected to the inside components utilizing two conductors.

It is therefore an object of this invention to provide a heat pump controller which will provide an interface between the existing control wiring and the control wiring of the heat pump so as to avoid the necessity of running additional conductors.

It is also an object of this invention to provide inside and outside electrical adaptors between the existing control wiring and the inside and outside heat pump system control wiring which will permit operation of the heat pump system in all its modes.

In accordance with these and other objects, which will become apparent hereafter, the instant invention will now be described with reference to the accompanying drawings.

DETAILED DESCRIPTION OF THE INVENTION

Figure 1:
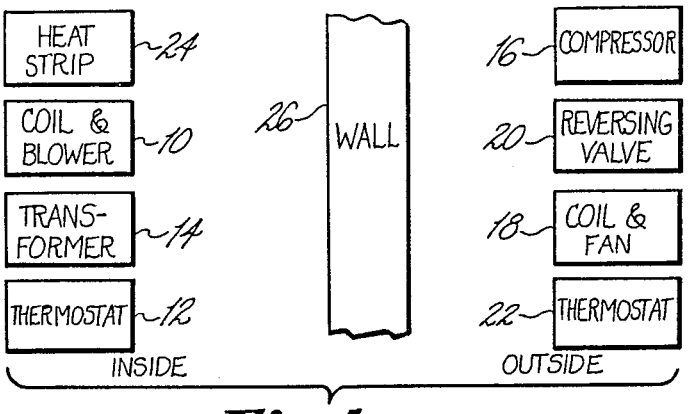
FIG. 1 shows schematically the inside and outside components of a heat pump system.

Although there are a number of different heat pumps and controls, in general there are common modes of operation and the same kinds of components. Moreover, there is common control wiring technology used by a majority of manufacturers known as the Honeywell Standard. Understanding the operation of the present invention is facilitated by first considering the various modes of operation of a heat pump system.

Normal Cooling

In normal cooling, the inside blower 10 moves air past the inside coil which contains cold refrigerant. This operation results when the inside thermostat 12 is set for cooling and the inside temperature rises above the set temperature. Blower 10 may be turned on independently of the inside temperature by setting the thermostat blower switch to "ON", or blower 10 may be set to operate under control of the inside thermostat by setting the switch to "AUTO".

On the outside, compressor 16 is operated by causing its drive motor to run. Outside fan 18 is operated to transfer heat from the coil to the air. If reversing valve 20 is not already in the correct position for the normal cooling operation, it is placed in this position.

Normal Heating

In normal heating, the inside blower 10 moves air past the inside coil which contains hot refrigerant. This operation results when the inside thermostat 12 is set for heating and the inside temperature falls below the set temperature. The outside thermostat 22 determines that the outside temperature is above the balance point. The balance point, it may be recalled, is the outside temperature below which the heat pump cannot extract enough heat from the outside air to maintain the desired inside temperature. Compressor 16 is operating, and reversing valve 20 is in position for normal heating. Fan 18 is operated to transfer heat from the ambient air to the cold refrigerant in the outside coil.

AUXILIARY HEATING

Auxiliary heating is similar to normal heating except that heat strip 24 is utilized to add heat to the indoor air to supplement the heat derived from the indoor coil and blower 10. Operation of auxiliary heating is controlled by the outdoor thermostat and is activated when the temperature falls below the balance point.

EMERGENCY HEATING

Emergency heating refers to heating supplied by heat strip 24 with no heat supplied by the heat pump. Emergency heating is utilized when the refrigeration system fails and it becomes necessary to obtain heat by another means. Actually, the heat strip is exemplary, a furnace could be the other means for supplying heat.

DEFROST

If the outside coil accumulates frost which is determined by a sensor, the heat strip is called to supply heat while the heat pump is operated in the normal cooling mode. Thus heat from the conditioned space will be transferred through the refrigerant system to the outside coil until the frost has been melted without adversely affecting the temperature of the conditioned space.

The heat pump systems are supplied with controls to effectuate the operations described above. These controls utilize 24 volt alternating current provided by transformer 14 which is normally carried by more than two conductors between the inside control components and the outside control components. Installation of the heat pump system includes installing a multiconductor cable which extends between the inside and the outside control components through wall 26. The person making the installation then connects each of the conductors, as directed by the instructions, to the appropriate terminal on the indoor and outdoor controls. The multiconductor control cable may have ten or more conductors, but not all conductors may be needed for a particular installation.

In replacement of straight cooling installations, it is sometimes found that an control cable having only two or three conductors is already in place, but it is not possible to pull this cable out and replace it with the designated new multiconductor cable, perhaps because of an intermediate junction box, bends in the cable, etc. In the past, the additional expense necessary to provide the new control cable may have caused potential purchasers of heat pumps to forego the purchase, or installations may have involved positioning of the control cable in an undesirable manner.

In accordance with the invention, control adaptors are provided for use in conjunction with the inside and outside controls. These control adaptors provide for the complete transmission of 24 volt control alternating currents without requiring a new multiconductor cable to be installed between the inside and outside controls. Instead, the existing two or three conductors are used to carry these currents.

Figure 2:
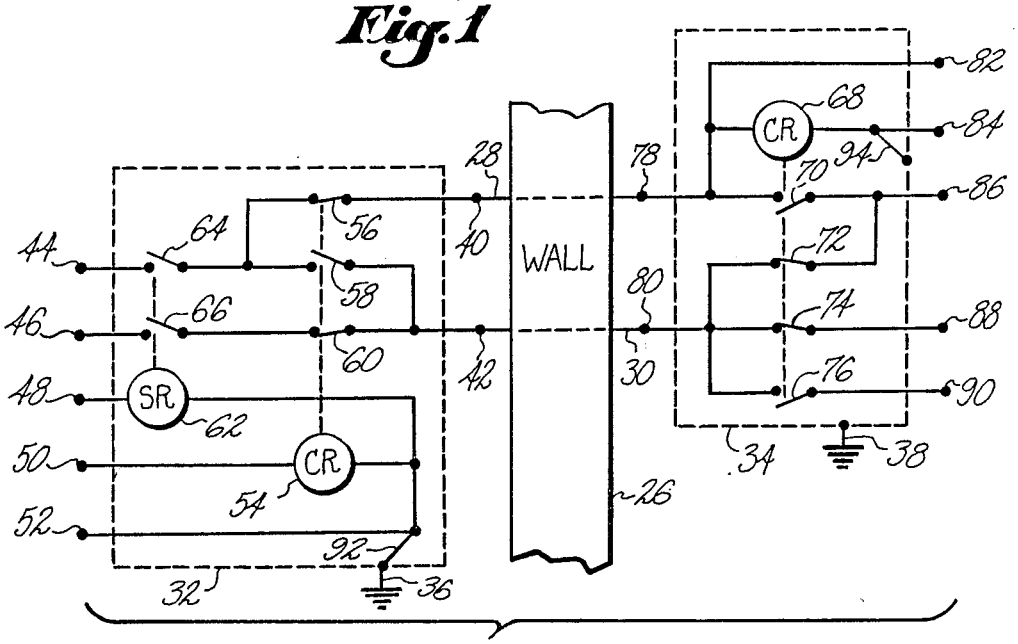
FIG. 2 shows schematically inside and outside electrical control adaptors in accordance with the invention for use where two conductors pass through the wall.

Referring to FIG. 2, wall 26 is illustrated as having two conductors 28 and 30 passing therethrough. An inside electrical control adaptor 32 is shown as having a metal housing represented by the dashed line. Similarly, dashed line 34 represents the metal housing of an outside electrical control adaptor. Metal housings are chosen in this embodiment for simplicity in providing ground connection 36 of adaptor 32 and ground connection 38 of adaptor 34. It will be recognized, however, that a housing of electrically insulating material could be substituted, and necessary ground connections provided through a terminal. This embodiment of the invention may only be used for installations where the previous outside and inside components had a continuous ground connection since the ground connection is utilized to complete low voltage alternating circuits.

Inside electrical control adaptor 32 is provided with external terminals 40 and 42 which are connected to the inside ends of conductors 28 and 30 respectively. Adaptor 32 is also provided with external terminals 44–52 to which are connected the control conductors of the inside connectors. It should be understood that terminals 44–52 are intended to be electrical substitutes for one end of a multiconductor cable having more than three conductors and probably six or more conductors. It should also be recognized that additional terminals could be provided on adaptor 32, but that these would not necessitate additional conductors passing through wall 26.

Contained within control adaptor 32 is control relay coil 54 which operates switches 56–60. As shown, switches 56 and 60 are normally closed, and switch 58 is normally open. This arrangement is used where reversing valve 20 of FIG. 1 is to be energized for heat pump cooling and not energized for heat pump heating. In heat pump systems where reversing valve 20 is to be energized for heat pump heating, switch 58 would be normally closed and switches 56 and 60 would be normally open. Also contained in electrical control adaptor 32 is slave relay coil 62 which operates normally open switches 64 and 66.

Outside electrical control adaptor 34 contains control relay 68 which operates switches 70–76. Switches 70 and 76 are normally open and switches 72 and 74 are normally closed. External terminals 78 and 80 are provided to be connected to the external ends of conductors 28 and 30. External terminals 82–90 are provided to be connected to the outside heat pump control terminals which normally would be connected to separate conductors of multiconductor cable.

Transformer 14 has a common terminal which is connected to terminal 52, and a switched side which is connected to terminal 44. Terminal 52 is connected through ground connection 92 to ground 36. Terminal 52 is also connected to one side of control relay coil 54 and slave relay coil 62. Terminal 46 is connected to the control for heat strip 24, terminal 48 is connected to the the compressor terminal on the thermostat 12 and the other side of slave relay coil 62 so as to close switches 64 and 66 when energized and terminal 50 is connected to the reversing valve terminal on the thermostat 12 and the other side of control relay 54 to close switch 58 and open switches 56 and 60 when energized.

On the outside electrical control adaptor 34, terminal 82 is provided to deliver current from the switched side of transformer 14. This terminal is connected to the defrost controls and by outside thermostat 22 to terminal 90 when auxiliary heat actuation is desired. Terminal 84 is grounded by ground connection 94 to the metal case of adaptor 34 and thence to ground 38. Terminal 84 is also connected to one side of control relay coil 68 and the common terminal on the heat pump control board. Terminal 86 is connected to the contactor for compressor 16, and terminal 88 is connected to cause actuation of reversing valve 20.

In the normal cooling mode of a system that energizes the reversing valve in cooling, current is supplied to both terminals 48 and 50 causing slave relay coil 62 and control relay coil 54 to be energized. Slave relay switches 64 and 66 are closed, control relay switch 58 is closed, and switches 56 and 60 are opened. Current will consequently flow from transformer terminal 44 to terminal 42 through inside adaptor 32. The current will pass through conductor 30 to terminal 80 on outside adaptor 34. Current will be supplied to terminals 86 and 88 to cause operation of both compressor 16 and actuation of reversing valve 20 (in this depiction, reversing valve is actuated for cooling by the heat pump). A control current is also provided to fan 18 by the wiring in the heat pump control. This current would typically be from the same terminal as that for compressor 16. (It is not the intent herein to describe all the control wiring which is a part of the heat pump system, since this is not a part of the present invention.)

In the normal heating mode of a system that energizes the reversing valve in cooling, a control current is again supplied to terminal 48 causing switches 64 and 66 to be closed. No current is supplied in this case to control relay 54, so that switches 56 and 60 remain closed and switch 58 remains open. In inside adaptor 32, current will flow from terminal 44 to terminal 40, and then through conductor 28 to terminal 78 on outside adaptor 34. Current will then flow through control relay coil 68 causing switches 70 and 76 to close, and switches 72 and 74 to open. Current will also flow to terminal 86 to cause operation of compressor 16 and fan 18. Because switch 76 is closed, a current can be delivered back to heat strip 24 to actuate this component providing this is called for by the outside thermostat 22. Thus the auxiliary heating mode of the heat pump system may be actuated under the control of the ourside thermostat. The defrost mode is a consequence of the heat pump being in the heating mode, and the outside coil accumulating frost. The inside thermostat is still requesting heat so that switches 64, 66, 56 and 60 are closed. The defrost control, however, causes reversing valve 20 to change to the cooling mode, stops current flow to fan 18 and delivers actuating current to terminal 90 and thus to conductor 30. It will be observed that conductor 30 carries an actuating current out to the compressor in the cooling mode and carries a current back to the heat strip when required in the normal heating modes.

Figure 3:
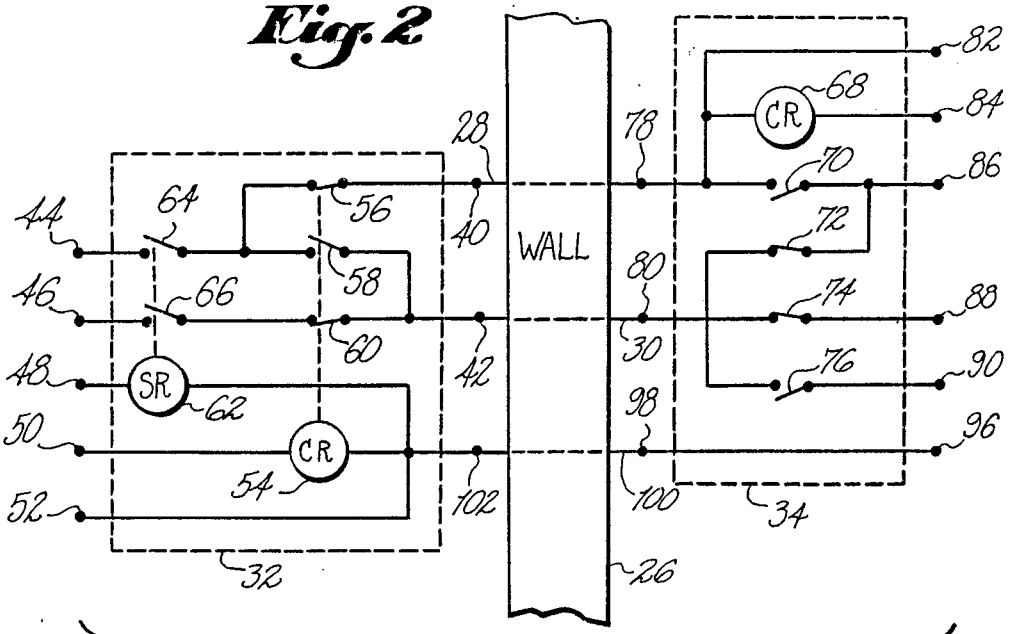
FIG. 3 shows schematically inside and outside electrical control adaptors in accordance with the invention for use where three conductors pass throught the wall.

In FIG. 3 the same identifying numbers are used to identify the parts which remain the same as in FIG. 2. The same modes of heat pump operation also involve the same terminals 44–52 on adaptor 32 and terminals 82–90 on adaptor 34. Additional terminal 96 is now provided on adaptor 34 to serve as the common line for the heat pump controller side. The other side of adaptor 34 has additional terminal 98 which is connected through adaptor 34 to terminal 96. A third conductor 100 is already in place through wall 26. This conductor is connected to terminal 98 on the outside and to terminal 102 on the inside adaptor 32. The common line continues through adaptor 32 to terminal 52, which is connected to the common side of the transformer 14 and it is also connected to one side of relay coils 54 and 62.

The control wiring for the heat pump systems as delivered by the manufacturer is marked with code letters so that connection of the control wiring can be specified by stating "connect the white conductor to terminal W", or similar language. Appropriate markings on the adaptors of the present invention permit the required connections to the external terminals of the adaptors to be easily made.

While the instant invention has been shown and described herein in what is conceived to be the most practical and preferred embodiment, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. In a heat pump system having a plurality of electrically controlled inside components on one side of a wall and a plurality of electrically controlled outside components on the other side of the wall requiring the transmission of different electrical control currents between the inside components and the outside components during different heat pump system operations, retrofit apparatus for providing connections between the required electrically controlled inside components and the required electrically controlled outside components over two existing conductors passing through the wall comprising:

inside and outside electrical adaptors;

said adaptors each having terminals for the two conductors;

said inside adaptor having terminals for the control conductors of the inside components;

said outside adaptor having terminals for the control conductors of the outside components;

said inside and outside adaptors having connecting means for connecting the controls of said inside and outside components for heating operation;

said connecting means also operable to connect the controls of said inside and outside components for cooling operation.

2. In the heat pump system as set forth in claim 1, wherein the connections between the required electrically controlled inside components and the required electrically controlled outside components are to be made over three existing conductors passing through the wall, apparatus wherein:

said adaptors each have terminals for the three conductors.

3. Apparatus in accordance with claim 1, wherein:

said connecting means is also operable to connect the controls of said inside and outside components for auxiliary heating.

4. Apparatus in accordance with claim 1 wherein:

said adaptors have means for connecting at least one control conductor terminal to ground.

5. Apparatus in accordance with claim 1 wherein:

said inside adaptor has terminals for five control conductors of the inside components;

said outside adaptor has terminals for five control conductors of the outside components;

said connecting means in said inside adaptor is two sets of relay operated switches; and said connecting means in said outside adaptor is a set of relay operated switches.

6. In a heat pump system having a plurality of electrically controlled inside components and a plurality of electrically controlled outside components requiring the transmission of different electrical control currents between the inside components and the outside components during heating and cooling operations, retrofit apparatus for providing control current transmission over two existing inside to outside conductors comprising:

an inside electrical adaptor having first and second terminals for the two inside to outside conductors, and third and fourth terminals for two inside control conductors;

relay means in said inside adaptor for selectively connecting said first terminal to said third terminal, and for selectively connecting said second terminal to either said third or fourth terminal;

an outside electrical adaptor having first and second terminals for the two inside to outside conductors, and third, fourth, fifth and sixth terminals for four outside control conductors;

relay means in said outside adaptor for selectively connecting said first terminal to said fourth, fifth and sixth terminals and for selectively connecting said second terminal to said third and fourth terminals.

7. In a heat pump system as set forth in claim 6, wherein the control current transmissions are to be made over three existing inside to outside conductors, apparatus wherein:

said inside adaptor has a fifth terminal for the third inside to outside conductor; and said outside adaptor has a seventh terminal for the third inside to outside conductor.

8. Apparatus as set forth in claim 6 further including:

fifth and sixth terminals for two inside control conductors on said inside adaptor; and said selective connection of said first terminal to said third terminal and said second terminal to said fourth terminal is caused by applying a current to said fifth and sixth terminals.

9. Apparatus as set forth in claim 6 further including:

fifth and sixth terminals for two inside control conductors on said inside adaptor; and said selective connection of said second terminal to said third is caused by applying a current to said fifth and sixth terminals.

10. Retrofit apparatus for electrically connecting the inside components and the outside components of a heat pump comprising:

an inside electrical adaptor having first and second terminal means for connecting one end of first and second existing electrical conductors, said first and second electrical conductors extending between the inside and the outside;

said inside adaptor also having third, fourth, fifth, sixth and seventh terminal means for connecting conductors from the inside components of the heat pump;

said inside adaptor having a first relay having an operating coil and first, second and third switches movable between open and closed positions;

said inside adaptor having a second relay having an operating coil and fourth and fifth switches movable between open and closed positions;

said first switch of said inside adaptor providing a connectable circuit from said first terminal to said fourth switch;

said second switch of said inside adaptor providing a connectable circuit from said second terminal to said fourth switch;

said third switch of said inside adaptor providing a connectable circuit from said third terminal to said fifth switch;

said fourth switch of said inside adaptor providing a connectable circuit to said third terminal;

said fifth switch of said inside adaptor providing a connectable circuit to said fourth terminal;

an outside electrical adaptor having first and second terminals for receiving the other end of the first and second electrical conductors extending between the inside and the outside;

said outside adaptor also having third, fourth, fifth, sixth and seventh terminals for connecting conductors from the outside components of the heat pump;

said outside adaptor having a relay having an operating coil and first, second, third and fourth switches movable between open and closed positions;

said first switch of said outside adaptor providing a connectable circuit from said first terminal to said fifth terminal;

said second switch of said outside adaptor providing a connectable circuit from said second terminal to said fifth terminal;

said third switch of said outside adaptor providing a connectable circuit from said second terminal to said sixth terminal;

said fourth switch of said outside adaptor providing a connectable circuit from said second terminal to said seventh terminal.

11. The apparatus in accordance with claim 10 wherein:

said inside adaptor has an eighth terminal for receiving one end of a third existing conductor extending between inside and outside;

said inside adaptor has a ninth terminal for receiving a conductor from the inside components;

said outside adaptor has an eighth terminal for receiving the other end of the third conductor extending between inside and outside;

said outside adaptor has a ninth terminal for receiving a conductor from the outside components.

* * * * *